United States Patent [19]

Bowler

[11] 4,341,193

[45] Jul. 27, 1982

[54] LOW PRESSURE THROTTLE BODY INJECTION APPARATUS

[75] Inventor: Lauren L. Bowler, Bloomfield Hills, Mich.

[73] Assignee: General Motors Corporation, Detroit, Mich.

[21] Appl. No.: 922,339

[22] Filed: Jul. 6, 1978

Related U.S. Application Data

[63] Continuation-in-part of Ser. No. 853,331, Nov. 21, 1977, abandoned.

[51] Int. Cl.[3] ..... F02M 39/00

[52] U.S. Cl. ..... 123/472; 123/446; 123/516; 123/541; 261/65

[58] Field of Search ..... 123/139 AW, 139 AT, 123/139 AK, 119 R, 32 AE, 32 EA, 445, 446, 472, 516, 541; 261/36 A, 69 A, 65, 116, 44 E, 62

[56] References Cited

U.S. PATENT DOCUMENTS

| | | | |
|---|---|---|---|
| 3,510,112 | 5/1970 | Winquist et al. | 123/139 AW |
| 3,545,948 | 12/1970 | Baverstock | 123/139 AW |
| 3,616,782 | 11/1971 | Matsui et al. | 123/139 AW |
| 3,635,201 | 1/1972 | High | 123/139 AW |
| 3,789,819 | 2/1974 | Moulds | 123/516 |
| 3,877,449 | 4/1975 | High | 123/119 R |
| 3,943,904 | 3/1976 | Byrne | 123/139 AW |
| 3,996,906 | 12/1976 | Bubniak et al. | 123/119 R |
| 4,066,721 | 1/1978 | Graham | 261/65 |
| 4,104,992 | 8/1978 | Fricker | 123/139 AW |

*Primary Examiner*—P. S. Lall
*Attorney, Agent, or Firm*—A. N. Krein

[57] ABSTRACT

A low pressure throttle body injection apparatus for a spark ignition internal combustion engine includes an injector mechanism mounted above a throttle body having at least one throttle bore with a throttle controlling flow therethrough. A valve controlled fuel injector is supported in a socket in the injector mechanism with its spray tip end positioned to inject fuel toward the throttle bore wall upstream of the throttle. An annular fuel well is defined by an internal socket wall and the exterior of the fuel injector, that is in communication with the valve end interior of the fuel injector via injector side ports. The injector mechanism defines a fuel inlet passage, including a fuel reservoir, opening into the fuel well and connectable to a source of low pressure fuel and a fuel return passage opening from the fuel well and connectable to the engine fuel supply tank. A pressure regulator connected in the fuel return passage is used to regulate the pressure of fuel in the fuel well. The injector mechanism further defines vapor flow passages for the flow of any fuel vapor from the fuel inlet passage to the fuel return passage. The amount of fuel entering the injector mechanism is substantially greater than the fuel discharge into the throttle bore by an amount sufficient to effect cooling of the injector mechanism so as to avoid substantial fuel vaporization at the fuel injector.

10 Claims, 7 Drawing Figures

LOW PRESSURE THROTTLE BODY INJECTION APPARATUS

FIELD OF THE INVENTION

This application is a continuation-in-part of my copending application Ser. No. 853,331, filed Nov. 21, 1977 and now abandoned.

This invention relates to fuel supply systems for internal combustion engines and, in particular, to a throttle body injection apparatus for supplying low pressure fuel and air into the intake manifold of a gasoline engine.

DESCRIPTION OF THE PRIOR ART

Various electronic fuel injection systems using electromagnetic fuel injectors for the injection of fuel to the cylinders of an internal combustion engine are well known. In one such type system presently in use on vehicle engines, a plurality of electromagnetic fuel injectors are used to meter controlled quantities of fuel, such as gasoline, to the intake ports of the respective cylinders of the engine in properly timed sequence.

In another type of fuel injection system one or two electromagnetic fuel injectors are positioned at a common point to supply fuel into the induction system for the engine so that the resulting air-fuel mixture can be supplied via the intake manifold to all of the cylinders of the engine. This latter system is sometimes referred to as a pressurized carburetor fuel system or a system using a fuel injection carburetor.

Because of the high volatility of gasoline fuel at low pressure and at elevated temperatures and altitudes, such prior art fuel injection systems have included therein a fuel pressure pump, such as a gear pump. This pump pressurizes the fuel, usually supplied to it by a low pressure fuel pump from the engine fuel tank, to a higher pressure. Usually this is a pressure of about 40 pounds per square inch or higher.

SUMMARY OF THE INVENTION

The present invention provides a throttle body injection system, which may be referred to as a single point injection system, for use with a gasoline engine. The throttle body injection system includes at least one fuel injector mounted in a fuel body housing with its injector nozzle positioned to inject fuel into the intake air stream at the inlet end of a throttle bore in a throttle body housing. Injection is above the throttle valve controlling flow through the throttle bore and into the intake manifold for the engine. The injector is supplied with low pressure gasoline fuel, as controlled by a pressure regulator, with the fuel supply passage to the injector and the fuel passage to the inlet side of the pressure regulator preferably being connected by restricted vapor vent passages.

Accordingly, the primary object of this invention is to provide an improved low pressure throttle body injection apparatus whereby the system is operative with fuel at a low supply pressure for supplying a controlled air-fuel mixture via the intake manifold to the cylinders of the engine, and the fuel is maintained in liquid form at all times for accurate metering.

Another object of the present invention is to provide an improved fuel supply mechanism of the throttle body type wherein the fuel is supplied at low pressure, such as 10 psi, and yet fuel at the metering point is substantially solid and effectively metered by the advantageous use of the relative low temperature fuel contained in the vehicle fuel tank.

Still another object of the present invention is to provide an improved fuel supply mechanism of the foregoing type wherein the fuel injector coacts with the housing in which it is placed to define an annular passage that bathes the injector for cooling effect and from which fuel is delivered to the valve seat of the injector, whereby excess fuel circulation from the fuel tank is effectively used to cool the injector, such excess fuel preferably being of the order of at least twice the maximum rate of fuel injection so that at less than maximum fuel injection the proportion of circulating to injecting fuel is substantially greater than two to one.

Another object of this invention is to provide an improved throttle body injection apparatus having at least one fuel injector mounted within a housing of heat conducting material above the throttle valve controlling air flow through a throttle body to effect proper fuel spray and mixing thereof with the induction air flowing through the throttle body and wherein the air flow wipes on the housing and via heat flow in the housing contributes to cooling the injector.

A further object of this invention is to provide improved throttle body injection apparatus having at least one fuel injector therein that is operable with low pressure gasoline fuel supplied thereto whereby the velocity of fuel flow at the fuel metering passage is low so that the buoyancy of fuel vapor will aid in assuring that only liquid fuel is present at the metering element of the fuel injector.

The present invention, in its preferred form, further contemplates limited vapor return passages to discharge any fuel in vapor form that exists therein.

A further object of the present invention is to provide a unitary apparatus mountable over the top face of the throttle body which includes both fuel pressure regulating elements and fuel injection elements and requires only a single fuel inlet and outlet connection, each of which goes directly to the fuel tank so that circulating fuel is heated to a minimum degree and the normally cool tank fuel is advantageously circulated to preclude overheating of the injector.

Still another object of the present invention is to provide an apparatus of the above type which includes features of construction, operation, and arrangement, rendering it easy and inexpensive to manufacture, reliable in operation, readily serviced, and in other respects suitable for use on production motor vehicles.

For a better understanding of the invention, as well as other objects and further features thereof, reference is had to the following detailed description of the invention to be read in connection with the accompanying drawings wherein.

DESCRIPTION OF A PREFERRED EMBODIMENT

Figure 1:
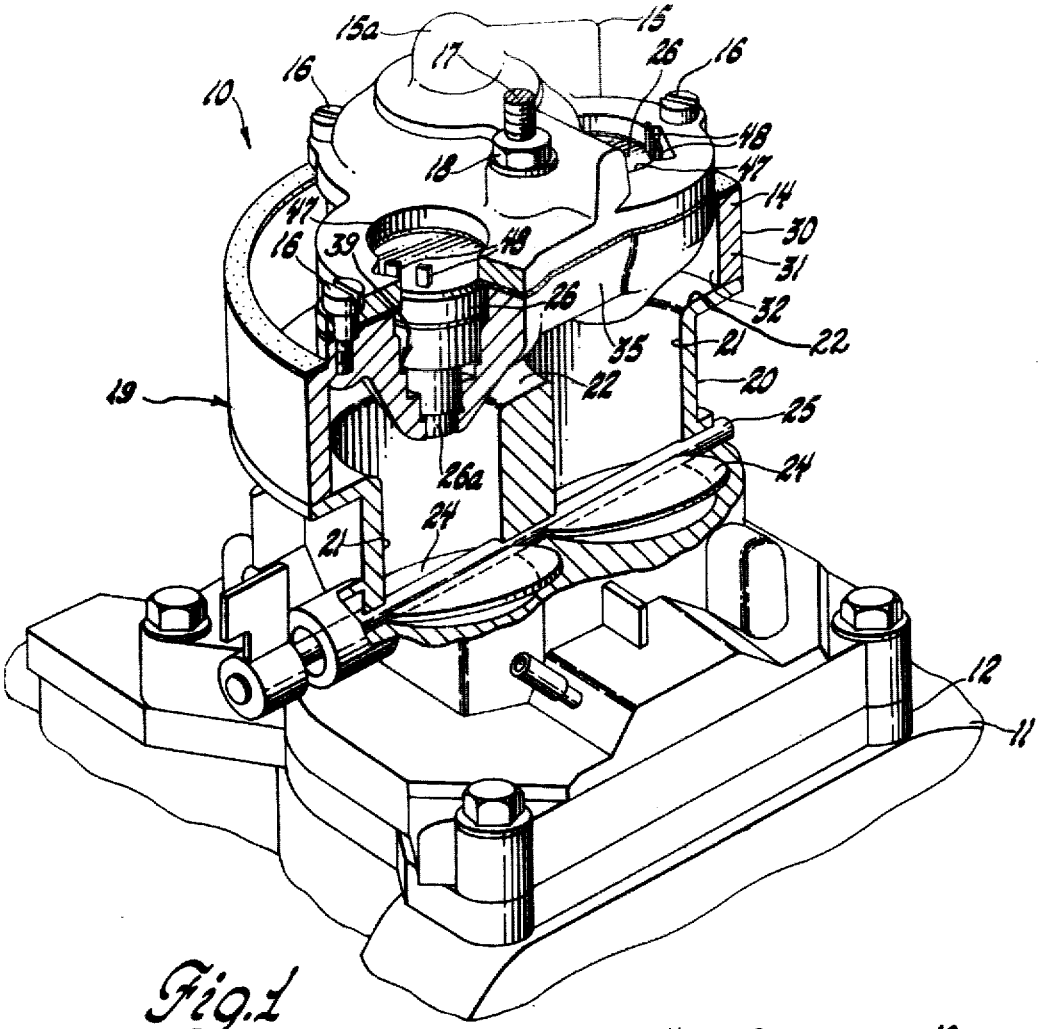
FIG. 1 is a perspective view of a preferred embodiment of a low pressure throttle body injection apparatus in accordance with the invention with the supporting engine parts in fragmentary form and with parts broken away to show its internal structure.
Figure 3:
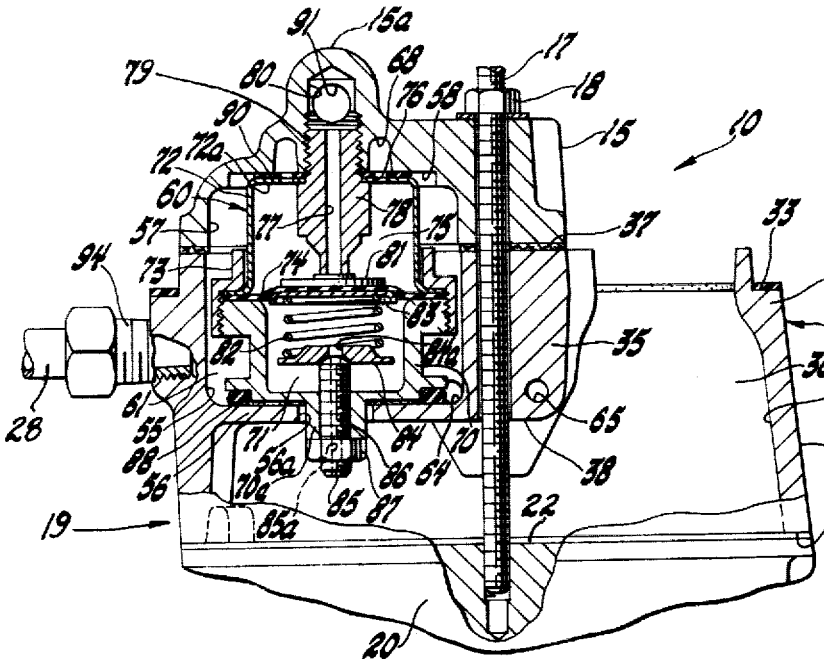
FIG. 3 is a sectional view taken along line 3--3 of FIG. 2 showing the pressure regulator and elements associated therewith with parts in elevation.

Referring first to FIG. 1, the throttle body injection apparatus, generally designated 10, of the invention is shown suitably fixed over the inlet of an engine intake manifold 11 with a heat insulating mounting plate 12 constructed of a fiberboard core with Buna-N. asbestos facing on both sides or equivalent materials positioned between its lower base surface and the usual mechined mounting pad on the top of the intake manifold. For ease of manufacture and assembly, the injector housing means of the subject throttle body injection apparatus, in the construction illustrated, includes a two piece fuel body assembly 19 that includes a fuel body 14 and a fuel body cover 15, suitably secured together as by screws 16, and mounted on a throttle body 20. The fuel body assembly is suitably secured to the throttle body 20 as by means of a threaded stud 17 and nut 18, as shown in FIG. 3. The stud 17 is also used to secure a conventional air cleaner, not shown, to this assembly.

Throttle body 20, in the construction shown, is provided with a pair of throttle bores 21 extending therethrough from an upper surface 22 to a lower surface 23 (FIG. 5) thereof. The throttle bores are cylindrical and have their axes substantially vertical, as shown. Flow through the throttle bores is controlled by throttle valves 24. Each throttle valve 24 is suitable fixed to a valve shaft 25 that intersects these bores and is rotatably journaled in the throttle body 20 whereby operation of these valves may be effected in a conventional manner not shown or described since it forms no part of the subject invention. For the same reason, other elements, such as air temperature and flow sensors, which may be associated with throttle body 20 as part of the control system for a fuel injection system are either not illustrated or not fully illustrated and are not described since they are not deemed necessary for an understanding of the subject invention.

To provide for the injection of fuel into the air stream flowing through the throttle bores 21, two electromagnetic fuel injectors 26, of a type capable of operation in a predetermined manner when supplied with fuel at a nominal low pressure of, 6 to 15 psi, for example, are supported by the fuel body 14, in a manner to be described, whereby each fuel injector supplies fuel to a single throttle bore.

The electromagnetic fuel injectors 26, may be of any suitable type but, are preferably of the type disclosed in copending U.S. Patent application Ser. No. 838,468 (now abandoned) entitled "Electromagnetic Fuel Injector" filed Oct. 3, 1977 in the name of James D. Palma, and assigned to a common assignee.

Fuel to be injected by each of the fuel injectors 26 into the induction system of the engine is supplied by a low pressure supply pump, not shown. This pump due to usage of the low fuel pressure referred to above, is preferably a turbine type pump, as distinguished from a positive displacement pump. Such pump is preferably located in the fuel tank which preferably incorporates therein a conventional bottom reservoir, not shown, used to insure a constant supply of fuel in the in-tank pump even at low fuel level and severe maneuvering conditions. At this location, the fuel would have little or no vapor entrapped therein. The fuel under low pressure is conveyed from the tank to the injectors via a suitable supply conduit 27 (FIG. 2) to a fuel delivery passage means which communicates with inlet chamber 61 of the fuel body assembly 19 for flow to the fuel injectors 26 as hereinafter described. Excess fuel delivered to these fuel injectors as described further hereafter, is returned to the fuel tank to mix with the fuel stored therein via a suitable return conduit 28.

Figure 2:
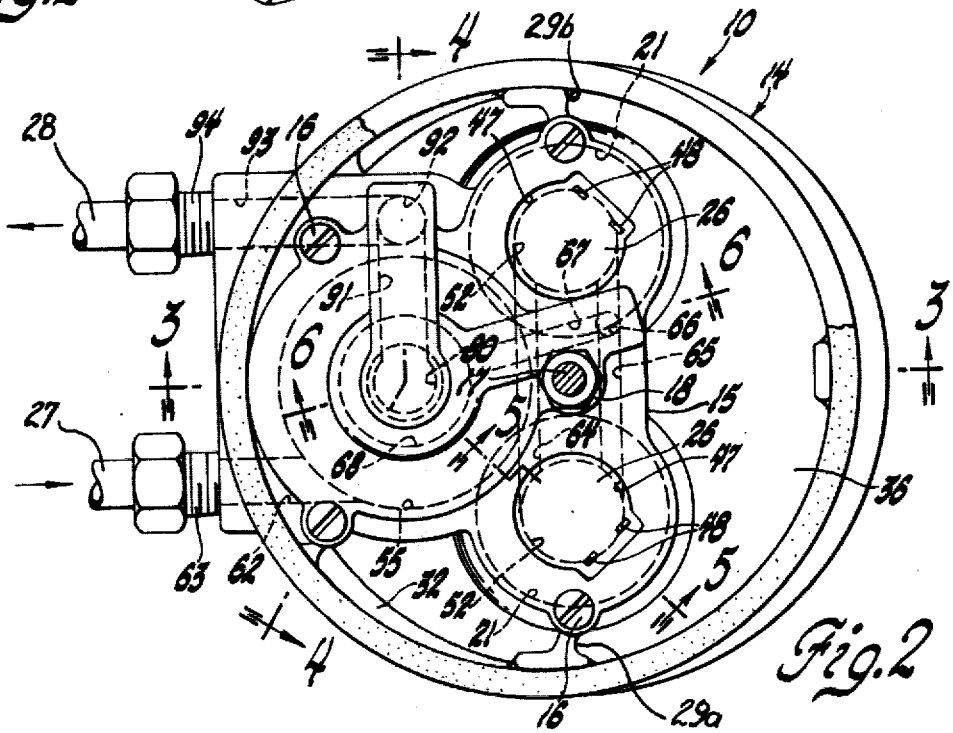
FIG. 2 is a top view of the apparatus of FIG. 1 with parts broken away.

As best seen in FIGS. 1, 2 and 3, the fuel body 14, in the construction shown, is a single casting. It includes an outer annular casing 30 providing outer cylindrical wall surface 31 and inner cylindrical wall surface 32 on the same axis. The cylindrical shape formed at the inner face 32 forms a manifold at the lower part of the body, from which air entering at the top of fuel body 14 is discharged into both throttle bores 21, FIG. 1. Upper and lower annular faces 33 and 34, respectively, are provided on casing 30. Body 14 additionally includes housing 35. As shown, in top plan view in FIG. 2 and in vertical cross-section in FIG. 3, the outer casing 30 is unitary with the housing 35 along the portion of the periphery of the casing 30 spanned by inlet and outlet passages 62 and 93, forming a cantilever-like support as seen best in FIG. 3. Further support is provided by spoke-like webs **29*a* and 29*b***, FIG. 2.

In the construction illustrated, the lower rim of a conventional air cleaner, not shown, would rest on the upper annular face 33 or on a gasket sandwiched therebetween.

An induction flow passage 36 is thus provided between the inner cylindrical wall surface 32 and the outer side surfaces of housing 35. The cross-sectional flow area of this induction flow passage is preferably at least about twice as large or larger than the combined cross-sectional flow area through throttle bores 21. The upper surface 37 of housing 35 is elevated above upper annular face 33 of casing 30 as shown in FIG. 3. The lower surface of the housing 35 is vertically positioned intermediate the upper and lower faces 33 and 34, respectively.

Figure 5:
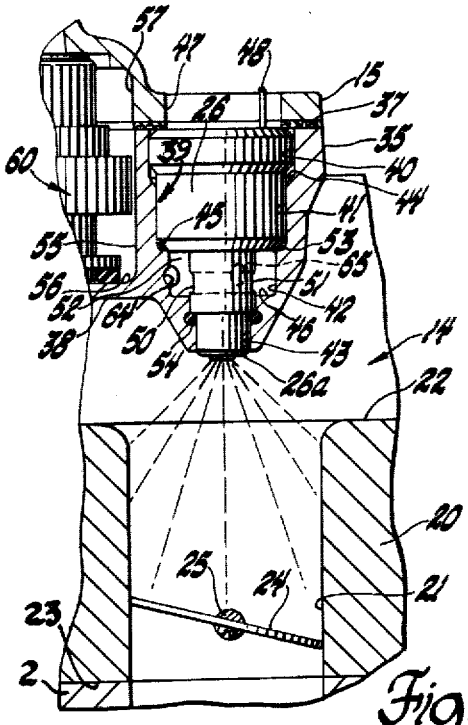
FIG. 5 is a view in elevation of one of the injectors with the associated elements shown in a fragmentary sectional view taken along line 5—5 of FIG. 2.

In the embodiment shown, housing 35 of fuel body 14 is provided with two sockets 39, FIG. 5, (described hereafter) in which the fuel injectors 26 are mounted. As shown, each socket 39 is formed by a through stepped vertical bore in the housing 35 that is substantially coaxial with one of the throttle bores 21 in the throttle body 20, as shown in FIG. 5. The socket is sized to correspond to the electromagnetic fuel injector 26 to be mounted therein. In the construction shown, each socket 39 provides a cylindrical upper wall 40, a cylindrical intermediate wall 41, a cylindrical lower intermediate wall 42 and cylindrical lower stepped wall 43. Such walls are progressively reduced diameters relative to the wall next above. Walls 40 and 41 are interconnected by a bevel shoulder 44. Walls 41 and 42 are connected by a more nearly flat shoulder 45. Walls 42 and 43 are connected by another nearly flat shoulder 46. Each electromagnetic fuel injector 26 is retained in the socket 39 in which it is mounted by the overlaying portion of the fuel body cover 15. Cover 15 has suitable apertures 47, to provide access to the electrical terminals 48 of the electromagnetic fuel injector 26. Electrical control circuit wires, not shown, are attached to the terminals and extend to a suitable electronic control circuit (not shown) that is operative to energize and de-energize each of the injectors as a function of engine operation in a desired manner as known in the art.

Each electromagnetic fuel injector 26 is positioned in its socket so that its spray tip end 26*a*, FIG. 5, is located at a predetermined axial spaced distance above the inlet end of the throttle bore 21 with which it is associated. The spray cone defined by liquid fuel discharged therefrom impinges on the cylindrical throttle bore wall 21, FIG. 5. The atomized fuel impinges on the upper portion of the throttle bore wall, but does not extend to the horizontal adjacent annular surface 22, FIG. 5. The spray also impinges on the upstream face of the throttle valve 24. Thus the position of the spray tip end 26*a* above the inlet end of the throttle bore 21 is preselected to provide for the above-described fuel spray flow pattern.

The spray pattern of the fuel injector provides maximum liquid fuel discharge toward the cylindrical wall 21 and minimum toward the throttle 24. In the preferred form of this invention, the fuel is delivered through the fuel injector in pulses. These pulses may be constant repetition rate, but of varying length, or they may be of uniform length and varying repetition rate, or a combination of varying repetition rate and varying length. Under low air flow rates, with the throttle closed or nearly closed, the fuel droplets can travel to the wall surface 21 so that each pulse event causes liquid fuel on this surface. The resulting film of liquid fuel tends to descend down the wall to points near the throttle where the high air velocity and low pressure encourage vaporization. This aspect of the inventions here described is described and claimed in U.S. Pat. No. 4,186,708.

The portions of the housing of the fuel injector 26 including the portion thereof containing the fuel inlet port 50 of the injector defines with the lower intermediate wall 42 and shoulder 46 an annular fuel chamber 52, FIG. 5. In a construction of FIGS. 1–5 made for use with a 350 cubic inch V-8 engine the diameter of the intermediate wall 42, FIG. 5, was 0.92 inches and its height was 0.36 inches. The volume of the annular fuel chamber 52 was 0.239 cubic inches. In operation, fuel flows into this passage at 15–22.5 gallons per hour, regardless of the rate of fuel injection, and the part of such flow going into the engine is less than a third of this amount. While these values are not deemed critical, they indicate ones that have been found effective.

Suitable O-ring seals 53 and 54 are used to effect seals between housing of the electromagnetic fuel injector 26 and suitable wall surfaces of the socket cavity with which it is associated on opposite ends of the fuel chamber 52.

Figure 4:
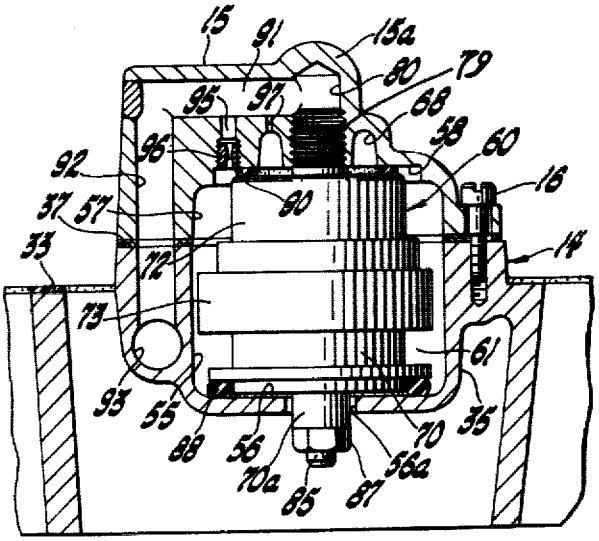
FIG. 4 is a view in elevation of the pressure regulator of the apparatus of FIGS. 1–3 with the associated elements in sectional view taken along line 4—4 of FIG. 2.

Fuel body 14, as best seen in FIGS. 3 and 4, is provided with an internal cylindrical wall 55 and a bottom wall 56 while its cover 15 is provided with an internal cylindrical wall 57 and upper wall 58 to define a chamber in which is mounted a fuel pressure regulator, generally designated 60 that forms with these walls an inlet fuel reservoir 61. The inlet fuel reservoir 61 is defined by cylindrical vertical walls 55, 57, FIGS. 2 and 3 and by the outer casing of the pressure regulator 60, FIG. 3.

Fuel is supplied to the inlet fuel reservoir 61, FIG. 3, via an inlet passage 62, FIG. 2, in fuel body 14 that opens at one end into reservoir 61 and is connected as by conduit fitting 63 and the supply conduit 27, FIG. 2, to the vehicle fuel tank or other suitable source of fuel, at a suitable low pressure of, for example, in the range of 6 to 15 psi. The fuel thus made available is relatively cool in relation to the temperatures present at the engine block and in the engine compartment of a vehicle. The fuel can be delivered at such a low pressure by a single in-tank fuel pump, preferably of the turbine type. Such fuel supply pumps are well known in the art. Fuel from the fuel reservoir chamber 61, FIG. 3, is delivered to the injector sockets by a fuel supply passage 64, FIGS. 2, 3, and 5. This passage extends horizontally in the housing 35 between the injector sockets as seen best in FIG. 2. This passage is so located that it also intersects the cylindrical chamber 61, as seen particularly in FIG. 3, so that fuel is delivered from chamber 61 to the respective injector sockets.

Figure 6:
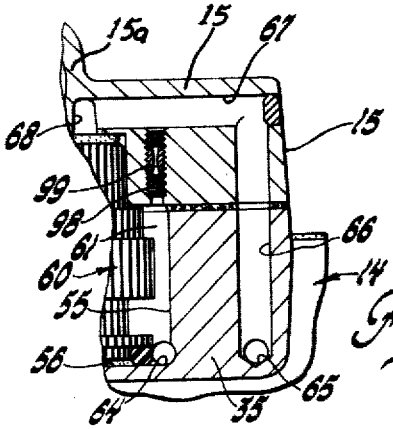
FIG. 6 is a fragmentary view taken along line 6—6 of FIG. 2 but showing an alternative form of the vapor return passage.

Excess fuel not injected into the induction passage means by the electromagnetic fuel injectors 26 is returned to the supply tank, not shown. To effect this, the fuel chambers 52, FIG. 5, of the injectors are connected by a common horizontal fuel return passage 65, FIGS. 2 and 3, in the housing 35 of the fuel body 14 to the lower end of a substantially vertical riser fuel return passage 66, provided in part in fuel body 14 and in part in cover 15 as best seen in FIG. 6. The latter communicates with horizontal passage 67 which extends toward the axis of the fuel regulator as shown in FIGS. 2 and 6. Passage 67 is provided in a raised boss 15*a* in cover 15 so as to be in fluid communication with a cylindrical open end channel 68, FIG. 3, in cover 15. Channel 68 encircles the axis of a raised boss 15*a* of cover 15, and is defined by an annular upwardly recessed groove formed in the upper wall 58 of the fuel body cover 15.

Any suitable fuel pressure regulator may be used. In the construction shown in FIG. 3, the fuel pressure regulator 60 includes a lower cup-shaped base 70 providing a first compartment 71. An inverted cup-shaped cover 72 is secured to the base 70 by a flange nut 73 threaded to the base. A flexible diaphragm 74 is secured between the base 70 and cover 72 to define a fuel return chamber 75 with the cover 72 and for separating compartment 71 from chamber 75.

Fuel inlet to the fuel return chamber 75 of the pressure regulator 60 is by means of a plurality of spaced apart apertures 76 in the upper wall 72*a* of cover 72. Fuel outlet from the regulator is by means of a substantially vertical through outlet passage 77 in the tubular valve seat element 78 that extends through a central aperture in the upper wall of the cover 72 which is provided for this purpose. The valve seat element 78 is suitably secured, as by an annular soldered joint, for example, to the cover 72. The lower end of the valve seat element 78, with reference to FIG. 3, extends a predetermined distance below the upper wall 72*a* to form an annular seat for valve 81. The opposite end of the valve seat element 78 is provided with external threads 79 for threaded engagement with the internally threaded vertical bore 80 that extends from upper wall 58 into the boss 15*a* of cover 15. With this arrangement, the pressure regulator 60 is adjustably secured to the cover 15 so that the housing means of this regulator depends into the cavity, previously described, that is provided in the fuel body 14 and cover 15.

Flow from the fuel return chamber 75 out through the outlet passage 77 is controlled by a diaphragm actuated valve 81 in the form of a disc suitably fixed to the upper or fuel return chamber side of diaphragm 74 for up and down movement therewith relative to the lower free end of valve seat element 78. Valve 81 is normally biased with a predetermined force into seating engagement with this end of the valve seat element 78 by means of a spring 82 positioned in compartment 71 so as to abut at one end against a disc retainer 83 fixed to the lower compartment 71 side of diaphragm 74. Spring 82, at its other end abuts against a spring seat disc 84. The spring seat disc has a central aperture 84*a* therethrough. This spring seat disc 84 is adjustably positioned in one direction axially within the compartment 71 by a spring pressure adjusting screw 85 that is threaded into the internally threaded aperture 86 through the central depending boss 70*a* of base 70. A nut 87 threaded onto screw 85 is used to releasably lock the screw 85 in its designed adjusted position.

The boss 70*a* is loosely received through an aperture 56*a* in the bottom wall 56 of the housing 35 of the fuel body 14. The screw 85 is provided with a through passage 85*a* aligned with the aperture 84*a* in spring seat disc 84 whereby the compartment 71 is placed in fluid communication with the fluid flowing within the induction flow passage 36.

As previously described, fuel pressure regulator 60 forms with the chamber defined by walls 55 and 56 of fuel body 14 and walls 57 and 58 of cover 15 an inlet fuel reservoir 61 which is flow isolated from the aperture 56*a* by means of a suitable seal, such as O-ring seal 88, positioned to encircle aperture 56*a* radially outward thereof. In the construction shown, the seal 88 is sandwiched between a lower flanged exterior wall surface 70*b* of base 70 and the bottom wall 56. Inlet fuel reservoir 61 is flow isolated from the annular fuel return channel 68 in cover 15 and from the inlet apertures 76 in the cover 72 of the fuel pressure regulator 60 by an O-ring seal or gasket 90 that is suitably sandwiched between the upper wall 72*a* of the cover 72 of the pressure regulator 60 and the upper wall 58 of cover 15.

Fuel flows from the fuel return chamber 75 out through the outlet passage 77 in the valve seat element 78 into the return passage provided by bore 80 in cover 15 then flows via a substantially horizontal return passage 91 that is in communication at one end with bore 80. At its other end this passage 91 is in communication with the upper end of a substantially vertical fuel return passage 92, FIG. 4, provided in part in cover 15 and in part in fuel body 14. Fuel return passage 92, at its lower end is in communication with a substantially horizontal discharge passage 93 provided in fuel body 14 as best seen in FIGS. 2 and 4. The discharge passage 92 is connected as by a conduit fitting 94 to the return conduit 28 whereby the excess fuel is returned to the fuel tank used to supply fuel to the engine.

The passages 65, 66 and 67 and the annular channel 68 thus define a first fuel return passage means connecting fuel chambers 52, to the inlet side of the fuel pressure regulator 60, as provided by the inlet apertures 76 thereof. The passage means, as provided by the bore 80 and the passages 91, 92 and 93, is defined as a second fuel return passage means that connects the outlet side thereof, as provided by the passage 77, of the fuel pressure regulator 60 to the engine fuel tank, not shown, in the manner previously described whereby excess fuel is returned via this passage means at a pressure corresponding to the pressure of fuel in the fuel tank, a pressure at or substantially corresponding to atmospheric pressure, assuming the fuel tank is properly vented in a conventional manner.

Suitable vapor bleed passage means are provided in the subject assembly whereby fuel vapors can be separated from the liquid fuel flow.

For this purpose, a vapor bleed passage 95 having a vapor bleed orifice 96 of predetermined diameter therein is provided in the fuel body cover 15, so as to open at one end into the uppermost portion of inlet fuel reservoir 61 and to open at its other end into a suitable portion of the second fuel return passage means such as the return passage 91 thereof in cover 15, as seen in FIG. 4. In addition, as seen in this same figure, a vapor bleed orifice passage means 97, of predetermined diameter is also provided in the cover 15 so as to open at one end into the uppermost portion of the annular channel 68 passage portion of the first fuel return passage means and to open at its other end into, for example, the return passage 91 of the second fuel return passage means, as shown.

In certain engine applications and for use with other types of electromagnetic fuel injectors, it may be desirable to provide a vapor bleed orifice passage in the subject assembly to provide for venting of any fuel vapors from the fuel being delivered to the electromagnetic fuel injectors. Such a vapor bleed orifice passage is positioned so as to connect the inlet fuel reservoir 61 to the first fuel return passage means, as for example, by means of a vapor bleed passage 98, having a bleed orifice 99 of predetermined diameter therein, that is provided in the cover 15 so as to open at one end into an uppermost portion of fuel chamber 61 and at its other end into the transverse passage 67 of the first fuel return passage means, as shown in FIG. 6.

Each of the above-described vapor bleed orifice means should be of a suitable small size so as to permit the flow of fuel vapor therethrough while minimizing the flow of liquid therethrough.

In operation, the gasoline fuel at a low supply pressure in the order of 6 to 15 psi, flowing via the inlet passage 62 into the inlet fuel reservoir 61 may have fuel vapors trapped in the liquid fuel. This entering fuel should have sufficient resident time in the inlet fuel reservoir 61, by proper sizing of this reservoir relative to the rate of fuel flow, so that the vapors can separate from the liquid fuel.

These fuel vapors separating from the liquid fuel will rise toward the upper wall 58 to flow out of the inlet fuel reservoir 61 via the vapor bleed passage 95, as controlled by the vapor bleed orifice 96, into the return passage 91 of the second fuel return passage means to be carried by the returning fuel therein back to the fuel tank for the engine.

In addition, if the throttle body injection apparatus 10 has the above-described vapor bleed passage 98 with the bleed orifice 99 therein, fuel vapors will also be bled from the inlet fuel reservoir 61 to the fuel flowing through the first fuel return passage means.

Thus fuel flowing from the inlet fuel reservoir 61 to the fuel chambers 52 supplying fuel to the electromagnetic fuel injectors 26 will be free or relatively free of fuel vapors. The quantity of fuel delivered to the throttle body apparatus 10 should be considerably in excess of that injected by the fuel injectors 26 into the induction system for the engine so that the excess fuel is used to cool the electromagnetic fuel injectors 26 and the fuel body assembly of the apparatus 10, and to purge any fuel vapors that may form within the fuel injectors 26 from these injectors whereby the valves thereof are always covered with liquid fuel so that fuel metering is not affected by the presence of fuel vapor.

Any fuel vapors entrained in the fuel flowing through the first return passage means is then bled therefrom via the vapor bleed orifice passage means 97 to the fuel in the second fuel return passage means prior to this fuel entering the fuel pressure regulator 60.

Fuel vapors returned to the fuel tank, not shown, may be removed therefrom, as desired, by any of the known fuel vapor recovery or evaporative emission control systems presently used in many automotive vehicles. In one such system, a vapor storage canister is used to receive and store fuel vapors emitted from the fuel tank of the vehicle engine. During engine operation, the fuel vapor stored in such a canister is then purged, as controlled by a suitable purge control valve, into the induction system of the engine so that these fuel vapors can be consumed therein.

The fuel flow to a throttle body injection apparatus 10, constructed in accordance with the invention, may be any suitable amount desired whereby excess fuel is available to effect fuel vapor purge and cooling of the apparatus 10 and of the electromagnetic fuel injectors 26. In a particular construction of such a throttle body injection apparatus 10 as used on a relatively large displacement V-8 engine, with this apparatus 10 having two electromagnetic fuel injectors 26 therein, the fuel flow was in the range of 30 to 45 gallons per hour. It will thus be apparent that, if the throttle body injection apparatus 10 is constructed for use, for example, on a four cylinder engine and has only one electromagnetic fuel injector 26 therein, the fuel delivery to this apparatus may be reduced so that the fuel flow is in the range of, for example, 15 to 30 gallons per hour. Of course, in both of the above examples, only a portion of the fuel thus delivered to a throttle body injection apparatus 10 will be injected by the electromagnetic fuel injectors 26 into the induction system of the engine for combustion within the working cylinders of the engine, the remaining amount being excess fuel.

Although the above fuel flow rates have been found satisfactory in the use described above, it has been found that these flow rates can be reduced in certain applications. However, the amount of fuel entering the apparatus should preferably be substantially greater than the fuel injected into the throttle body in an amount sufficient to effect cooling of the fuel body assembly 19 and the injectors therein so as to avoid substantial fuel vaporization at the fuel metering orifice passages.

Figure 7:
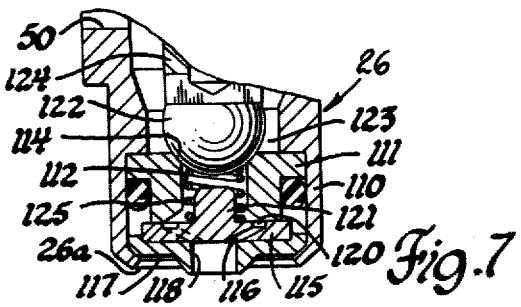
FIG. 7 is an axial sectional view of the lower nozzle portion of an exemplary electromagnetic fuel injector usable in the apparatus of FIGS. 1-5.

As previously described, the electromagnetic fuel injectors 26 are preferably of the type disclosed in the above-identified, copending United States patent application Ser. No. 838,468 and, as such, would be of the type that includes a solenoid actuated valve used to control fuel flow through the nozzle assembly of such an injector. In the construction illustrated in FIG. 7, the nozzle assembly of this type electromagnetic fuel injector 26 is mounted in the lower wall nozzle case portion of the injector body 110 of the injector 26 and includes in succession a seat element 111 in the form of an annular disc which is provided with a central axial outlet port or flow passage 112 therethrough and with a conical valve seat 114 on its upper surface concentric with the flow passage 112, a disc-like swirl director plate 115 having a plurality of circumferentially spaced apart, inclined and axially extending, director passages 116 therethrough, and a spray tip 117 with a spray orifice passage 118 therethrough.

As shown, the director passages 116 in the swirl director plate 115 extend from an annular groove 120 on the upper face of the swirl director plate 115 positioned to encircle an upstanding boss 121 of the swirl director plate which is loosely received in the flow passage 112 through the seat element 111.

Flow through the flow passage 112 in the seat element 111 is controlled by a valve 122 loosely received within a fuel chamber 123 in the injector body that is in flow communication with the inlet and outlet ports 50 and 51, respectively. Valve 122 is vertically movable between a closed position at which it is seated against the valve seat 114 and an open or vertically raised position relative to the valve seat. As shown, the valve 122 is of a ball-like configuration, and in the construction illustrated, is of semi-spherical shape, that is, it is a ball truncated at one end to provide a flat or plane surface on its upper side, the lower portion being of ball-shaped configuration whereby to be self-centering and to seat against the conical valve seat 114.

The solenoid, of the electromagnetic fuel injector 26 has a vertically movable armature 124, which is normally spring biased, the spring not being shown, so that when the solenoid is de-energized the lower slotted end of the armature abuts against the valve 122 to move the valve 122 downward to its closed position in seating engagement against the valve seat 114. The valve 122 is thus an electrically actuated metering valve.

Unseating of the valve 122 from the valve seat 114 is preferably effected by means of a compression valve spring 125. The valve spring 125 is loosely received in the flow passage 112 of the seat element 111 in position to abut at one end against the upper surface of the director plate 115 and to abut at its opposite end against the lower, ball portion of the valve 122. As shown, the upstanding boss 121 not only serves to center the spring 125, but also to appreciably reduce the volume capacity available for fuel in the flow passage 112. During operation, normal seating and actuation of the valve 122 is controlled by the armature 124 of the solenoid assembly of the injector 26 and, accordingly, it will be apparent that the spring 125 only effects unseating of the valve 122 when the solenoid is energized.

Other details of this type of electromagnetic fuel injector 26 are not shown or described, since such details are not deemed necessary for an understanding of the subject invention and, since such details are fully disclosed in the above-identified copending United States patent application Ser. No. 838,468, the disclosure of which is incorporated herein by reference thereto.

During engine operation, the electromagnetic fuel injectors 26 will inject fuel when energized or electrically pulsed. As above described, these electromagnetic fuel injectors 26 may be pulsed at a varying repetition rate, such as once per engine cylinder, in timed relation to the movement of the crankshaft, not shown, therein so as to discharge fuel into the throttle bores above the throttle valves whereby to provide a desired mixture to the intake manifold 11 of the engine for distribution to the cylinders, not shown, of the engine. When two injectors 26 are used, as in the embodiment illustrated, these injectors will receive alternate pulses with possible overlap of pulses depending on engine operation, and they may be pulsed simultaneously to effect acceleration enrichment.

As previously described, each electromagnetic fuel injector 26 is positioned above the throttle bore 21 with which it is associated so that during fuel injection the fuel is discharged toward the wall of the throttle bore 21 above the throttle valve 24 therein at a distance equivalent to one bore diameter. Preferably each injector 26 provides a symmetrical and uniform fuel delivery into its associated throttle bore 21. Preferably the fuel is injected in a hollow cone spray pattern of a symmetric pattern onto the upper internal wall portion of the throttle bore above the throttle valve therein. Thus again referring to FIG. 7, during fuel injection, fuel flowing through each of the director passages 116 of the injector nozzle assembly is discharged into the spray orifice passage 118 thereof with an eddying or swirl motion such that this swirling movement imparted to the fuel continues as the fuel flows out of the spray orifice passage 118. Such a cone spray pattern provides proper fuel distribution to wet the peripheral wall surface defining the upper portion of the throttle bore under low air flow conditions at closed or nearly closed throttle.

In addition with the above arrangement, by providing fuel intake into an electromagnetic fuel injector 26 at its lower end next adjacent to the valve 122 movable therein to valve seat 114 therein and by maintaining a low fuel flow velocity therethrough, the buoyancy of any fuel vapor present will leave only liquid or so-called solid fuel at the metering lands of these elements. In the preferred embodiment of the electromagnetic fuel injector 26 shown, it will be apparent that fuel flow path therethrough is not tortuous and in fact is a relatively open substantially horizontal flow path whereby to permit fuel vapors to separate from the fuel in a manner so that liquid fuel only is present at the lower metering end of the injector.

By including the electromagnetic fuel injectors 26 and the fuel pressure regulator 60 as an integrated part of the throttle body injection housing assembly, all of these elements and the fuel passages interconnecting these elements are in the intake air flow path to provide for cooling of these elements and of the low pressure fuel therein under hot operating conditions.

In the appended claims I have referred to the space 52, FIG. 5, as the fuel well. As is evident from this figure, the space is defined by the outer surface of the depending portion of the injector 26 on the inside and on the outside is defined by the bore portion 42 of the housing 14. The space is annular, and the fuel flowing into it through passage 64, FIGS. 5 and 2, and out of it through passage 65 seen in the same figures, travels circumferentially around the space and wipes the outside face of the depending portion of the injector 26 to cool the same. Fuel also travels from this space through the passage 50, FIGS. 5 and 7, to the fuel space 123, FIG. 7, which is in communication with the valve seat 114 and hence the fuel discharge passage 112. In addition to the direct cooling action effected by the fuel wiping against the outside surface of the depending portion of the injector 26, the circulating fuel in the fuel well thermally communicates otherwise with the housing 14 so as to cool the same and maintain the fuel space or chamber 123 and the fuel passage 112 and other elements at the discharge part of the injector 26 at a sufficiently cool temperature to provide liquid fuel therein.

What I claim as new and desire to secure by Letters Patent of the United States is:

1. A low pressure fuel supply mechanism for a spark ignition internal combustion engine having a throttle body defining a substantially vertical air intake passage and a movable throttle therein, comprising:

an injector mechanism mounted above said air intake passage and adapted to receive fuel at said low pressure, said injector mechanism having a fuel discharge passage through which fuel flows generally downwardly and is discharged into said air intake passage, the mechanism defining a valve seat at the upper end of the passage and a fuel space about said valve seat, the mechanism further having a vertically movable valve member effective to close said fuel discharge passage at said seat;

said injector mechanism also defining (a) an annular fuel well substantially horizontally aligned with said fuel space and radially outboard the same (b) a generally horizontally oriented fuel intake passage into said fuel space from said annular fuel well (c) a fuel intake passage opening into said fuel well at one peripheral point and (d) a fuel return passage opening from said fuel well at a point circumferentially spaced from said one peripheral point to return excess fuel from the same, whereby excess fuel circulates peripherally about the annular fuel well to establish cooling heat flow communication from the circulating fuel to the fuel at the said fuel discharge passage;

the passages being so proportioned and located that the amount of fuel entering the injector mechanism is substantially greater than the fuel injected into the throttle body in an amount sufficient to avoid substantial fuel vaporization at the metering orifice.

2. A low pressure fuel supply mechanism for a spark ignition internal combustion engine having a throttle body defining a substantially vertical air intake passage and a movable throttle therein, comprising:

an injector mechanism mounted above said air intake passage and adapted to receive fuel at said low pressure, said injector mechanism having a fuel discharge passage through which fuel flows generally downwardly and is discharged into said air intake passage, the mechanism defining a valve seat at the upper end of the passage and a fuel space about the valve seat, the mechanism further having a vertically movable valve member effective to close said fuel discharge passage at said seat;

said injector mechanism also defining (a) an annular fuel well substantially horizontally aligned with said fuel space and radially outward the same, (b) a generally horizontally oriented fuel intake port into said fuel space from said annular fuel well, (c) a fuel intake passage opening into said fuel well at one point, (d) a fuel return passage opening from said fuel well at a point spaced from said one point to return excess fuel from the same, and (e) at least one vapor return passage opening from said fuel intake passage upstream of said annular fuel well to discharge fuel vapor therefrom to said fuel return passage, whereby excess liquid fuel circulates through the annular fuel space to establish cooling heat flow communication between the circulating fuel and the fuel in said fuel space;

the passages being so proportioned and located that the fuel entering the injector mechanism is in excess of that injected whereby to provide excess fuel for cooling to thereby avoid substantial fuel vaporization adjacent to said valve seat.

3. A low pressure fuel supply mechanism for an internal combustion engine having at least one substantially vertical air intake passage, comprising:

an injector mechanism mounted above said intake passage and adapted to receive fuel at said low pressure, said mechanism defining a fuel passage through which fuel flows downwardly and is discharged into said intake passage, said mechanism further defining an annular valve seat located above said discharge opening and a fuel space at said valve seat, a valve disposed within the injector mechanism and adapted in a lowered position to seal said valve seat and in an elevated position to form an annular fuel passage in cooperation with said valve seat so that the amount of liquid fuel entering the engine is determined by the proportion of time said valve is in elevated position;

the injector mechanism further defining an annular fuel well encircling said fuel space and radially outboard the same, said fuel well being separated from the fuel space by a heat conducting wall with at least one fuel passage therethrough to provide fuel flow from the fuel well to the fuel space, said fuel well having a fuel inlet passage and a fuel return passage at circumferentially spaced points whereby fuel entering the inlet and escaping through the fuel return wipes said wall to provide heat transfer cooling fuel in the fuel space;

said mechanism being constructed and arranged so that the amount of fuel entering the injector mechanism is greater than the fuel injected in an amount sufficient to circulate through the annular space between the inlet and fuel escape passages to avoid substantial fuel vaporization at said annular space.

4. A low pressure fuel supply mechanism for an internal combustion engine having at least one substantially vertical air intake passage, comprising:

an injector mechanism mounted above said intake passage and adapted to receive fuel at said low pressure, said mechanism defining a fuel passage through which fuel flows downwardly and is discharged into said intake passage, said mechanism further defining an annular valve seat located above said fuel passage and a fuel space at said valve seat;

a valve disposed within the injector mechanism and adapted in a lowered position to seal said valve seat and in an elevated position to form an annular fuel passage in cooperation with said valve seat so that the amount of liquid fuel entering the engine is determined by the proportion of time said valve is in elevated position;

the injector mechanism further defining a fuel well encircling said fuel space and radially outboard the same, said fuel well being separated from the fuel space by a heat conducting wall with at least one fuel port therethrough to provide a fuel flow from the fuel well to the fuel space, said fuel well having a fuel inlet passage and a fuel return passage at spaced locations whereby fuel entering through the inlet passage and escaping through the fuel return passage wipes said wall to provide heat transfer cooling of the fuel in the fuel space; said injector mechanism defining at least one vapor return passage opening into said fuel return passage from upstream of said fuel well whereby substantially only liquid fuel is present for flow through said annular fuel passage;

said mechanism being constructed and arranged so that the amount of fuel entering the injector mechanism is substantially greater than the fuel injected through the discharge opening in an amount sufficient to avoid substantial fuel vaporization at the metering orifice between said valve and said valve seat.

5. A low pressure fuel supply mechanism for an internal combustion engine having at least one substantially vertical air intake passage, comprising:

an injector mechanism mounted above said intake passage and adapted to receive fuel at said low pressure, said mechanism defining a fuel passage through which fuel flows downwardly and is discharged into said intake passage, said mechanism further defining an annular valve seat located above said discharge opening and a fuel space at said valve seat;

a valve disposed within the injector mechanism and adapted in a lowered position to seal said valve seat and in an elevated position to form an annular fuel passage in cooperation with said valve seat so that the amount of liquid fuel entering the engine is determined by the proportion of time said valve is in elevated position;

the injector mechanism further defining a fuel wall separated from the fuel space by a heat conducting wall with at least one fuel passage therethrough to provide fuel flow from the fuel well to the fuel space, said injector mechanism having a fuel inlet passage and a fuel return passage in spaced apart communication with the fuel well whereby fuel entering the fuel inlet and escaping through the fuel return wipes said wall with fuel to provide heat transfer cooling the fuel in the fuel space;

said mechanism being constructed and arranged so that the amount of fuel entering the injector mechanism is substantially greater than the fuel injected into the intake passage in an amount sufficient to effect substantial heat transfer cooling of the fuel in said fuel space whereby to avoid substantial fuel vaporization at the fuel space.

6. A unit to receive low pressure fuel and to discharge the same in metered action into each of a pair of upstanding spaced throttle bores of a gasoline internal combustion engine, wherein a substantially cylindrical unit surmounts the open upper ends of the bores to define a manifold space, said unit comprising:

a housing structure having a support web joined to the said unit along the circumferential length defined by a chord substantially parallel to the plane defined by the axes of the throttle bores, said housing defining a pressure regulator portion adjacent said chord and injector portions disposed above and in alignment with each of the bores, respectively, the housing being of material having good heat conduction and defining surfaces across which the air entering the bores wipes in cooling action;

a pressure regulator in the regulator portion of said housing and an injector in each of the injector portions of said housing, each injector having a valve seat and annular intake chamber therefor so that liquid fuel flows in metered quantity from said chamber through the valve seat and is injected into the bore, the housing further defining a fuel well in thermal communication with each said annular intake chamber, respectively, the housing having passages for fuel flow from a source to said fuel wells and out of said fuel wells, respectively, to said pressure regulator, whereby the regulator maintains a predetermined low pressure upstream itself and fuel flowing through the same removes heat, said injectors each further having at least one passage from its respective fuel well to each said intake chamber, respectively, to deliver fuel to the same for injection;

the apparatus being constructed and arranged so that the amount of fuel entering said housing structure is substantially greater than the rate of fuel discharge through said valve seats in an amount sufficient to circulate through the pressure regulator to effect cooling of the housing structure and of said injectors whereby to avoid substantial fuel vaporization at said injectors.

7. A unit to receive low pressure fuel and to discharge the same in metered action into each of a pair of upstanding spaced throttle bores of a gasoline internal combustion engine, wherein a substantially cylindrical unit surmounts the open upper ends of the bores to define a manifold space, said unit comprising:

a housing structure having a support web joined to the said unit along the circumferential length defined by a chord substantially parallel to the plane defined by the axes of the throttle bores, said housing defining a pressure regulator portion adjacent said chord and injector portions disposed above and in alignment with each of the bores, respectively, the housing being of material having good heat conduction and defining surfaces across which the air entering the bores wipes in cooling action;

a pressure regulator in the regulator portion of said housing and an injector in each of the injector portions of said housing, each injector having a valve seat and annular intake chamber therefor so that liquid fuel flows in metered quantity from said chamber through the valve seat and is injected into the bore, the housing further defining a fuel well in thermal communication with each said annular intake chamber, respectively, the housing having passages for fuel flow from a source to said fuel wells and out of said fuel wells, respectively, to said pressure regulator, whereby the regulator maintains a predetermined low pressure upstream itself passages and fuel flowing through the same removes heat, said housing having at least one vapor return passage located to effect bypass of fuel vapor in one of the fuel wells or the fuel space to the downstream side of the pressure regulator, said housing further having at least one passage from each fuel well to each chamber, respectively, to deliver fuel to the same for injection;

the apparatus being constructed and arranged so that the amount of fuel entering said housing is substantially in excess of the rate of fuel discharge through said valve seats in an amount sufficient to effect cooling whereby to avoid substantial fuel vaporization at said valve seats.

8. A fuel-air management system comprising a throttle body adapted for connection to an intake manifold of an internal combustion engine, said throttle body having a plurality of induction bores wherein each of said induction bores is associated with the intake manifold and each of said air induction bores includes:

a throttle assembly having a rotatable throttle plate for controlling the amount of air flow through said induction bore;

a fuel injector jacket having a pressurized fuel accumulation chamber;

suspension means for suspending said fuel injector jacket immediately over the entrance to or in said air induction bore above the throttle plate; and an intermittent fuel injection valve mounted in said jacket to meter fuel from said accumulation chamber into the air flow of the induction bore before it reaches the throttle plate, said injection valve having a hollow conical spray pattern wherein the spray pattern directs substantially all of the injected fuel at the opening between the periphery of the throttle plate and the wall of the air induction bore when the throttle plate is rotated.

9. A fuel-air management system comprising a throttle body adapted for connection to a intake manifold of an internal combustion engine, said throttle body having a plurality of induction bores wherein each of said induction bores is associated with the intake manifold and each of said air induction bores includes:

a throttle assembly having a rotatable throttle plate for controlling the amount of air flow through said induction bore;

a fuel injector jacket having a pressurized fuel accumulation chamber;

suspension means for suspending said fuel injector jacket above the throttle plate; and an intermittent fuel injection valve mounted in said jacket to meter fuel from said accumulation chamber into the air flow of the injection bore before it reaches the throttle plate, said injection valve having a hollow conical spray pattern.

10. A fuel-air management system comprising a throttle body adapted for connection to an intake manifold of an internal combustion engine, said throttle body having an induction bore which includes:

a throttle assembly having a rotatable throttle plate for controlling the amount of air flow through said induction bore;

a fuel injector jacket having a pressurized fuel accumulation chamber;

suspension means for suspending said fuel injector jacket above said air induction bore and throttle plate; and an intermittent fuel injection valve mounted in said jacket to meter fuel from said accumulation chamber into the air flow of the induction bore before it reaches the throttle plate, said injection valve having a hollow conical spray pattern wherein the spray pattern directs injected fuel at the opening between the periphery of the throttle plate and the wall of the air induction bore when the engine runs under open throttle operation and above said opening when the engine runs under closed throttle operation.

* * * * *